United States Patent [19]

Graham

[11] 4,037,995

[45] July 26, 1977

[54] LIQUID PROPELLANT GUN (DAMPER)

[75] Inventor: Alfred Rapp Graham, Burnt Hills, N.Y.

[73] Assignee: General Electric Company, Burlington, Vt.

[21] Appl. No.: 694,868

[22] Filed: June 10, 1976

[51] Int. Cl.[2] ..... F04B 17/00

[52] U.S. Cl. ..... 417/349; 417/377; 417/381

[58] Field of Search ..... 89/7, 9, 1 K; 417/349, 417/377, 381; 60/39.01

[56] References Cited

U.S. PATENT DOCUMENTS

| | | | |
|---|---|---|---|
| 2,605,708 | 8/1952 | Smedes | 417/377 X |
| 2,884,000 | 4/1959 | Witter | 417/377 X |
| 2,981,153 | 4/1961 | Wilson et al. | 89/7 |
| 2,986,072 | 5/1961 | Hudson | 89/7 |
| 3,138,990 | 6/1964 | Jukes et al. | 89/7 |

*Primary Examiner*—David H. Brown
*Attorney, Agent, or Firm*—Bailin L. Kuch

[57] ABSTRACT

A liquid propellant gun utilizes a differential piston having a plurality of bores through its head, which head divides the liquid propellant pumping chamber from the combustion chamber, and propellant supply means providing liquid propellant under pressure into said pumping chamber, which propellant under pressure both advances the piston to enlarge the pumping chamber and to decrease the combustion chamber and injects and atomizes a predetermined quantity of propellant through said bores from said pumping chamber into said combustion chamber, and a check valve which precludes flow of liquid propellant under pressure from said piston to said propellant supply means and damps said piston at the end of its combustion stroke.

5 Claims, 5 Drawing Figures

LIQUID PROPELLANT GUN (DAMPER)

BACKGROUND OF THE INVENTION

1. Field of the Invention

This invention relates to liquid propellant guns utilizing a differential piston to provide continued or regenerative injection of propellant into the combustion chambers after initial ignition of propellant in the chamber.

2. Prior Art

Liquid propellant guns utilizing differential pistons to pump propellant into the combustion chamber during combustion are now well-known. Early work is described in a Final Report of 19 Nov. 53–31 Jan. 56 under contract DA-36-034-ORD-1504RD, Project TSI-47-8 by V. M. Barnes, Jr. et al which apparently in part corresponds to Jukes et al, U.S. Pat. No. 3,138,990 filed Oct. 9, 1961; in a report No. 17-2 of June 15, 1954 under contract NOrd-10448 by C. R. Foster et al; and in a Final Report of Sept. 1, 1957 under contract NOrd 16217, Task 1, by L. C. Elmore et al. Other patents of interest are J. W. Treat, Jr., U.S. Pat. No. 2,922,341, filed Nov. 7, 1955; E. J. Wilson, Jr. et al, U.S. Pat. No. 2,981,153, filed Nov. 14, 1952; C. M. Hudson; U.S. Pat. No. 2,986,072, filed Nov. 19, 1952; and E. J. Vass et al, U.S. Pat. No. 3,690,255 filed Oct. 1, 1970. Certain of these patents, e.g. Jukes et al, show the use of valves to control the entrance of propellant into the combustion chamber.

An object of this invention is to provide an improved check valve for a liquid propellant gun having a combustor assembly utilizing a differential piston which will preclude ullage at the supply face of said piston and which will provide damping of said piston at the end of its combustion stroke.

A feature of this invention is the provision of a liquid propellant gun utilizing a differential piston having a plurality of bores through its head, which head divides the liquid propellant pumping chamber from the combustion chamber, and propellant supply means providing liquid propellant under fixed feed pressure into said pumping chamber, which propellant under pressure both advances the piston to enlarge the pumping chamber and to decrease the combustion chamber while increasing pressure in said combustion chamber and injects and atomizes a predetermined quantity of propellant through said bores from said pumping chamber into said combustion chamber, and a check valve which precludes flow of liquid propellant under pressure from said piston to said propellant supply means and damps said piston at the end of its combustion stroke.

RELATED CASES

Subject matter directed to the differential piston disclosed herein is claimed in the application of A. R. Graham, filed concurrently herewith, Ser. No. 694,866. Subject matter directed to another form of the check valve is disclosed and claimed in the application of D. P. Tassie, filed concurrently herewith, Ser. No. 694,867.

BRIEF DESCRIPTION OF THE DRAWING

These and other objects, advantages and features of the invention will be apparent from the following specification thereof taken in conjunction with the accompanying drawing in which.

DESCRIPTION OF THE PREFERRED EMBODIMENT

Figure 1:
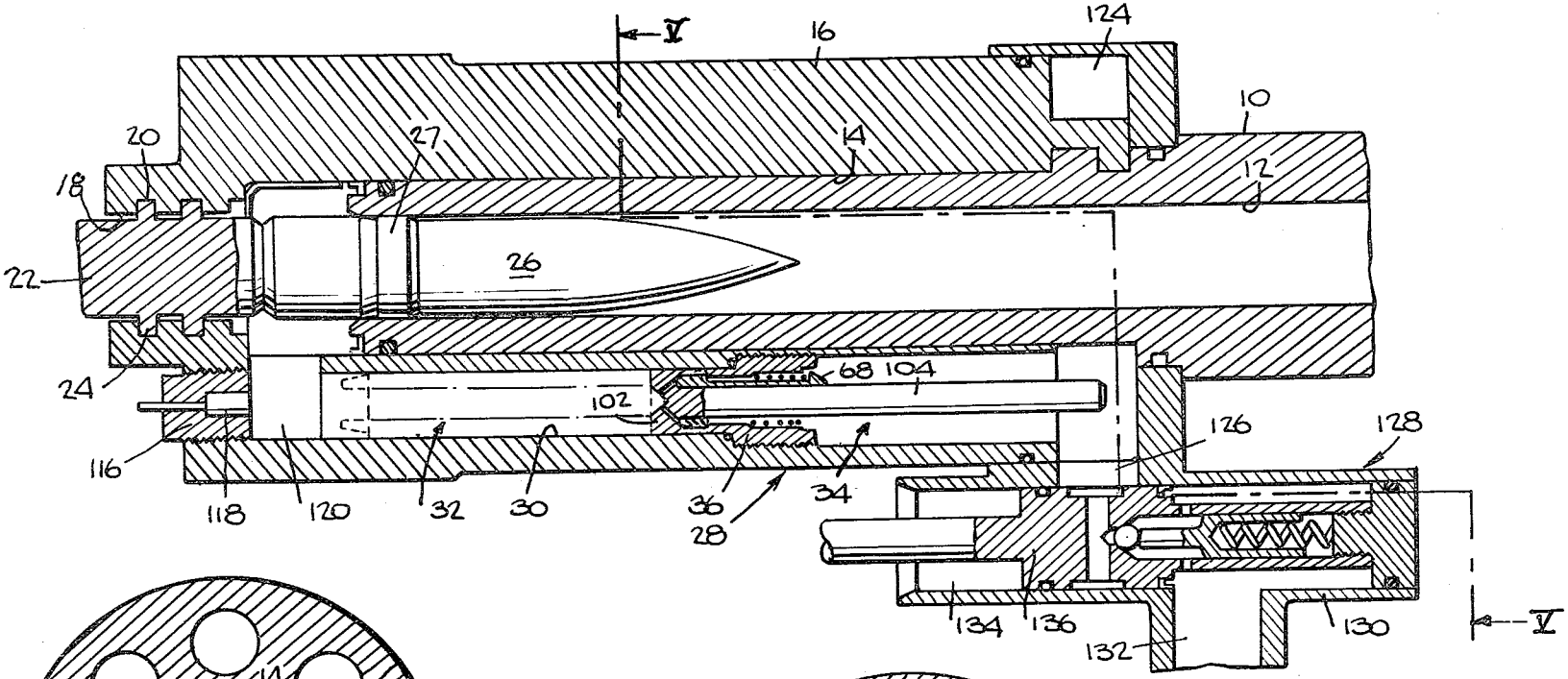
FIG. 1 is a detail view in longitudinal cross-section of a gun incorporating a combustor assembly embodying this invention.
Figure 3:
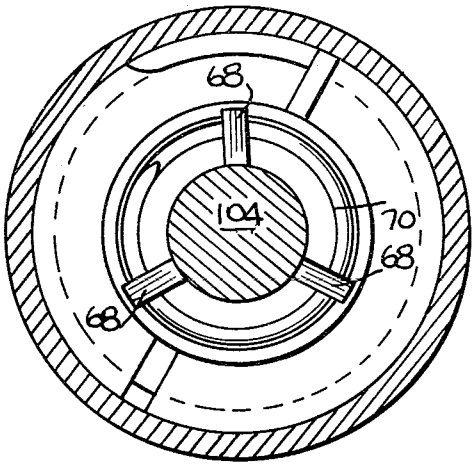
FIG. 3 is a transverse view in cross-section taken along the plane III—III of FIG. 2.

This invention, as shown in FIG. 1, may be incorporated in a liquid propellant gun of the type shown by D. P. Tassie in U.S. Pat. No. 3,763,739. However, the invention as here shown utilizes a monopropellant, although the regenerative piston system is applicable to bipropellants as well.

The gun system includes a gun barrel 10, having a gun bore 12, which is fixed in a forward bore 14 of a housing 16. The housing has an aft bore 18, with a plurality of locking recesses 20, which receives a gun bolt 22 having a plurality of locking lugs 24. A projectile 26 having a rotating band 27 may be inserted through the aft bore 18 and pushed forwardly into the gun bore 12 by the bolt 22, which bolt is then locked in and to the housing. The band 27 makes a gas tight seal with the bore.

Figure 5:
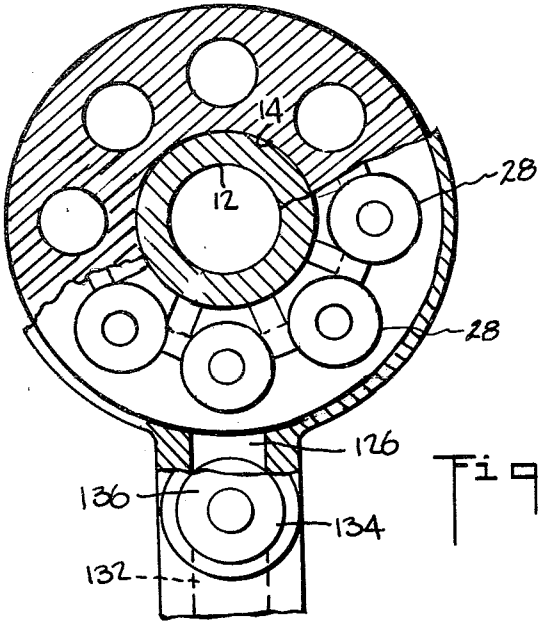
FIG. 5 is a transverse view in cross-section of a gun incorporating a plurality of the combustor assemblies of FIG. 1 taken along the folded plan V—V.
Figure 2:
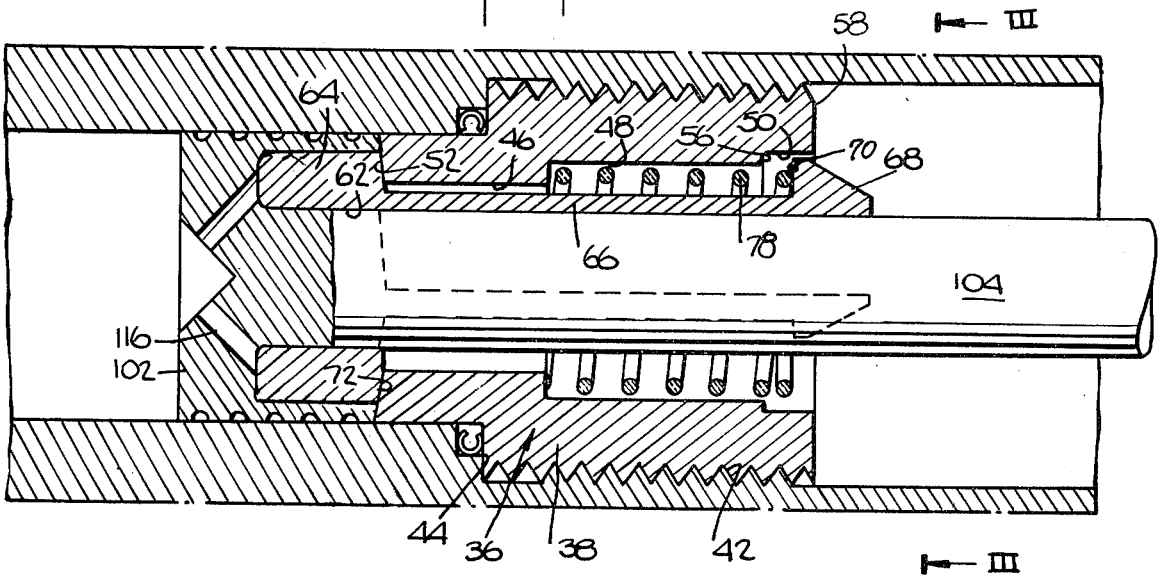
FIG. 2 is an enlarged detail of FIG. 1 of the combustor assembly in the end of propellant injection mode.
Figure 4:
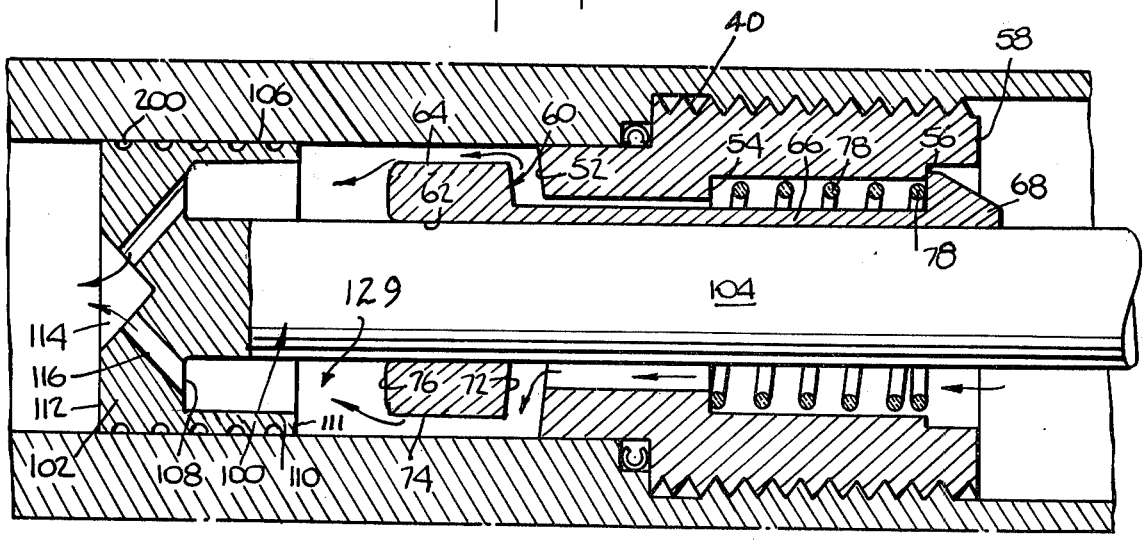
FIG. 4 is an enlarged detail of FIG. 1 of the combustor assembly in the propellant filling mode.

The housing 16 may have one, or as shown in FIG. 5, a plurality of combustor assemblies 28. As shown in FIGS. 1, 2 and 4, each combustor assembly includes a longitudinal bore 30 having a combustion chamber portion 32 and a liquid propellant inlet chamber portion 34. A coaxial check valve 36 is fixed in the bore 30 and includes an outer annular housing 38 which is externally threaded at 40 to engage threads 42 and a shoulder 44 in the bore 30, and has a longitudinal bore in three stepped portions: a portion 46 having the smallest diameter, a portion 48 having an intermediate diameter, and a portion 50 having the largest diameter. The housing 38 has a left face 52, an internal shoulder 54, an internal shoulder 56, and a right face 58. A sleeve 60 has a longitudinal bore 62, a left, truncated conical, annular head portion 64, and a tail portion including an intermediate portion provided by a plurality (here shown as three) of longitudinally extending, circumferentially spaced apart, beams 66, and a right portion provided a like plurality of heel, enlarged terminations 68 on each beam. The right portion has a left face 70 which will abut the shoulder 56, the left portion has a right face 72 which will mate with and will seal against the face 52, a cylindrical, peripheral face 74, and a left face 76. A helical compression spring 78 is disposed between the shoulder 54 and the face 70 and biases the sleeve 60 to the right.

A piston 100 has a head portion 102 which slides in the combustion chamber portion 32 and a stem portion 104 which slides in the bore 62 of the sleeve 60. The head portion has an L-ring longitudinal cross-section with an outer-peripheral surface 106 for sliding engagement with the wall of chamber 32, a right transverse annular surface 108 which will mate with and will seal against the face 76, a right cylindrical annular surface 110 which will mate with and will seal against the face 74, a left face 112 having a conical recess 114, and a plurality of bores 116 disposed in an annular row and interconnecting the face 108 with the recess 114. Alternatively, these bores may be arranged as axial bores and in other configurations.

The left end of the combustion chamber 32 is closed by a plug 116 which carries a spark plug 118. A respective radial bore 120 communicates between the respective combustion chamber 32 and the left end of the bore 12.

The right end of each liquid propellant inlet chamber portion 34. opens into an annular passageway or manifold 124, which in turn is open, at 126, to a propellant supply valve 128. The valve includes a housing 130 having an inlet port 132, a cylinder 134, and a spool 136. The spool may be cam controlled, as shown in U.S. Pat. No. 3,763,739, for synchronization with the other gun functions.

As shown in FIG. 1, before loading, the valve 128 is closed and the piston 100 is in its righthandmost position wherein it is nested with and sealed to the check valve 36. A projectile 26 is inserted into the gun bore 12 and the bolt 22 is closed and locked. The spool 136 is shifted to the left, opening the valve 128, admitting liquid propellant under pressure into the manifold 124. Propellant under pressure passes into the chamber portion 34 and into the longitudinal recesses between the beams 68, and applies pressure against the surface 72 of the portion 64 to shift the portion, against the bias of the spring 78, away from the surface 52, to permit the flow of liquid propellant around the portion 64 and against the surfaces 108 and 110 of the head 102 of the piston. This pressure provided by the incoming liquid propellant pushes the piston head to the left, creating and enlarging the available volume of a propellant pumping chamber portion 129 and decreasing the available volume of the combustion chamber portion. A small quantity of the liquid propellant passes through the bores 116 into the combustion chamber portion during this shifting or piston head, and thus a quantity of air which had entered when the bolt was open, plus this quantity of liquid propellant, are compressed and trapped in the combustion chamber. The liquid propellant is atomized as it passes through the bores, and the total quantity and the size of the droplets is a function, inter alia, of the diameter of the bores, the configuration of the bores such as axial or impinging (FIG. 4), and the pressure of the liquid propellant. When the piston head has reached its maximum excursion in compression, that is, leftmost travel, the liquid pressure in the pumping chamber portion 129 equals the liquid pressure in the supply manifold 124 and the supply chamber portion 34 and the spring 78 drives the sleeve 60 to the right, thereby closing the check valve 36. This quantity of compressed air and atomized propellant in the combustion chamber portion adjacent the sparkplug is predetermined and repeatable, and serves as a primer for the combustion of the main charge of propellant disposed in the supply chamber portion. Ignition of this primer is provided by the sparkplug. Ignition of the primer generates combustion gas whose pressure drives the piston to the right to increase the volume of the combustion chamber portion and to decrease the volume of the pumping chamber portion. The difference in areas of the two faces of the piston generates a difference in pressure in the two chambers so that liquid propellant is continually forced through the bores 116 into the combustion chamber at a controlled rate. The piston head is displaced continually to the right towards the closed check valve 36. As the piston head closes onto the annulus 74 of the check valve the remainder of the liquid propellant trapped therebetween provides an energy absorbing function and absorbs the energy of the moving piston head as it impacts against the check valve annulus, without any ullage. The interface surfaces 110 and 74 are cylindrical to trap liquid between the valve housing left face 52 and the piston head L-ring section 106 and prevent such liquid from reaching and passing through the bores 116. This trapped liquid is squeezed out through grooves 200, and provides damping.

A plurality of shallow, helical grooves 200 are provided in the peripheral surface of the piston head, communicating from the left face 112 to the right face, adjacent 110. Liquid propellant is forced through these grooves at the same time as through the bores 116 to provide additional damping and to lubricate this interface. The cross sectional area of said helical grooves 200, may be varied to provide any degree of damping required. Actual cross sectional area of said grooves may be determined by a combination of conventional calculations and experimentation. All lubricant passing into the combustion chamber portion will be in a swirl pattern, thus providing a film cooling effect to the chamber bore 30, after which it will be burned, either as primer, or as part of the main charge. A fresh supply of lubricant is provided during each firing cycle, and will clean out any particles which may lodge in the grooves. In a 35 caliber piston configuration having ten injection bores 116 having diameters of .072 inches, 16 U-shaped grooves 0.02 × 0.02 inches arranged at a 30° angle to the longitudinal axis provided adequate damping, which could not be achieved in this case by the configuration described in the application of D. P. Tarrie filed concurrently here with Ser. No. 694,867.

Lubrication of the interface between the piston stem and the check valve sleeve is also provided by the liquid propellant.

The interface between the piston stem 104 and the bore 62 may be without seals, since any leakage from the pumping chamber portion will merely pass back into the supply chamber portion. The L-ring section 106 provides an effective seal between the hot gun gas in the combustion chamber and the relatively cold liquid in the pumping chamber portion, in that there is a difference in pressure on the piston head which provides for the flow of liquid propellant from the pumping chamber to the combustion chamber, which precludes any flow of gun gas from the combustion chamber to the pumping chamber.

The leakage propellant will act as a booster as well as a primer. The piston compresses air in front of it, and then creates a two phase mixture in front of it, which on ignition, acts as a booster charge. A small booster charge results in a much faster initial chamber pressure rise which improves ballistic efficiency.

What is claimed is:

1. A pump comprising:

a cylinder having a longitudinal bore with a longitudinal axis, an inner wall, an inlet end and an outlet end;

a check valve coaxial with said longitudinal axis and closing said cylinder bore inlet end, including:

an outer annular housing fixed to and sealed within said cylinder bore inner wall, and having a longitudinal bore coaxial with said longitudinal axis and a first, substantially transverse, cylinder bore inlet end remote face, an annular sleeve disposed within said housing bore and having an annular head portion remote from said cylinder bore inlet end, a tail portion provided by a plurality of circumferentially spaced apart beams extending longitudinally from said head portion and proximal to said cylinder bore inlet end; and having a longitudinal bore coaxial with said longitudinal axis, said sleeve head portion having a first, substantially transverse, cylinder bore inlet end remote face, a second, substantially transverse, cylinder bore inlet end proximal face, and third cylindrical face, and spring means biasing said sleeve towards said cylinder bore inlet end so that said sleeve head second face abuts and seals against said housing first face;

a piston having a head portion with a cylindrical surface journaled within and against said cylinder bore wall and a stem portion journaled within said sleeve bore, said piston head portion having a first, substantially transverse, check valve distal face and a second check valve proximal face, which is formed of a first inner, transverse, annular subface, a second outer, transverse, annular subface, and a third cylindrical subface extending to and between said subfaces, said piston head second face first and third subfaces and said piston stem portion forming a first cavity adapted to receive and congruently interfit with a plug formed by said sleeve head portion first and third faces, a first plurality of bores communicating to and between said piston head first face and said piston head second face first subface, providing a fluid outlet from said first cavity when plugged, said annular sleeve head portion third face, said housing first face and said cylinder bore inner wall forming a second cavity adapted to receive and congruently interfit with a plug formed by said piston head second face second subface and third subface, a second plurality of grooves in said piston head portion cylindrical surface and communicating to and between said piston head first face and said piston head second face second subface, providing a fluid outlet from said second cavity when plugged.

2. A pump comprising:

a cylinder having a bore on a longitudinal axis with an inlet end and an outlet end;

a piston having a head journaled for reciprocation in said cylinder bore along said longitudinal axis, said head having a first face which is proximate to said bore outlet end and has a first effective transverse area, a second face which is proximate to said bore inlet end and has a second effective transverse area which is less than said first area, a cylindrical surface about said longitudinal axis and extending to and between said first and second faces and riding against the interior wall of said cylinder bore, at least one bore of a first diameter passing through said head to and between said first and second faces, at least one groove in said head cylindrical surface extending to and between said first and second transverse faces at an angle to said longitudinal axis, of a second diameter, first means disposed in said bore inlet end for initially inletting a quantity of liquid into said bore through said inlet end and for subsequently closing said inlet end, having a first face proximate to said piston head second face, second means for traversing said head towards said first means, said piston head second face and said first means first face, at a first longitudinal spacing between said piston head and said first means, mutually defining a first closed cavity having a first outlet through said piston head bore and a second outlet through said piston head groove, and at a second longitudinal spacing between said piston head and said first means, which second spacing is less than said first spacing, mutually defining a second closed cavity having an outlet through said piston head bore and a third closed cavity having an outlet through said piston head groove.

3. A pump according to claim 2 wherein:

said second diameter of said groove is smaller than said first diameter of said bore.

4. A pump according to claim 2 wherein:

said second cavity is closed off from said third cavity, whereby liquid is initially inlet through said first means into said first cavity and is passed out through both said piston head bore and said piston head groove, and subsequently said first cavity is subdivided into said second and said third cavities and liquid in said second cavity is passed out through said piston head bore and liquid in said third cavity is passed out through said piston head grooves.

5. A pump according to claim 4 wherein:

said piston head bore is one of a plurality of such bores, and said piston head groove is one of a plurality of such grooves.

* * * * *

UNITED STATES PATENT OFFICE

CERTIFICATE OF CORRECTION

Patent No. 4,037,995 Dated July 26, 1977

Inventor(s) Alfred Rapp Graham

It is certified that error appears in the above-identified patent and that said Letters Patent are hereby corrected as shown below:

Column 3, line 37 change "or" to --of --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*